United States Patent [19]

Burton, Jr. et al.

[11] 4,133,300

[45] Jan. 9, 1979

[54] VENTILATING RANGE HOOD

[75] Inventors: Fred Burton, Jr., Dallas; Marshall N. Gartenlaub, Richardson; Kenneth E. Sampsel, Dallas, all of Tex.

[73] Assignee: Home Metal Products Company, Plano, Tex.

[21] Appl. No.: 820,867

[22] Filed: Aug. 1, 1977

[51] Int. Cl.[2] ..... F24C 15/08; F23J 11/00

[52] U.S. Cl. ..... 126/299 D; 55/DIG. 36

[58] Field of Search ..... 126/299 D; 55/DIG. 36

[56] References Cited

U.S. PATENT DOCUMENTS

| | | | |
|---|---|---|---|
| Re. 27,225 | 11/1971 | Stalker | 126/299 D |
| 2,962,955 | 12/1960 | Bernstein | 126/299 D |
| 2,993,428 | 7/1961 | Wermager | 126/299 D |
| 3,064,551 | 11/1962 | Stalker | 126/299 D |
| 3,075,335 | 1/1963 | Bandlow | 126/299 D |
| 3,077,825 | 2/1963 | Jensen | 126/299 D |
| 3,125,869 | 3/1964 | Winton | 126/299 D |
| 3,249,037 | 5/1966 | Stalker | 126/299 D |
| 3,292,524 | 12/1966 | Cole | 126/299 D |
| 3,359,885 | 12/1967 | Faehling | 126/299 D |

OTHER PUBLICATIONS

Home Metal Products Company: *Kitchen Changers* (undated).

*Primary Examiner*—Ronald C. Capossela
*Attorney, Agent, or Firm*—Richards, Harris & Medlock

[57] ABSTRACT

A ventilating range hood adapted to provide a number of selectable exhaust paths for air brought into the range hood from the ambient. The ventilating hood utilizes an enclosure having a removable plate in the top cover to provide an upwardly directed exhaust path through a cylindrical vent duct or a rectangular vent duct. A second removable plate is provided in the back wall of the enclosure to provide a rearwardly directed exhaust path through a rear vent duct. A removable closure plate is provided on the front wall of the enclosure to provide access to openings in the front wall defining a forwardly directed exhaust path.

5 Claims, 8 Drawing Figures

VENTILATING RANGE HOOD

BACKGROUND OF THE INVENTION

The present invention relates to a ventilating hood for placement over a source of heat and smoke, such as a kitchen range, to remove and exhaust heat and smoke from the area. More particularly, the present invention relates to a ventilating range hood having a number of selectable exhaust paths.

It is conventional in modern homes for a ventilating range hood to be provided over the kitchen stove to remove smoke and heat produced during cooking. Typically, a ventilating range hood will have a hood shell with an intake opening in the bottom and a fan or blower assembly for drawing heated air and smoke into the intake. In exhausing the heated air and smoke from the range hood, it is generally preferred to provide an exhaust path through the top of the hood shell by attaching a large cylindrical duct to the hood shell and extending ductwork upwardly through the building structure to the outside. However, it is oftentimes the case that the structural arrangement of the building or residence does not permit an exhaust duct to be extended through the space above. For example, necessary structural members may be extending above the range hood, a second-story room may be positioned above the range hood, or storage cabinets may be built-in above the range hood. Accordingly, it becomes necessary to provide alternate exhaust paths for the range hood.

It is often the case that an upwardly directed exhaust path through a top vent in the range hood can be provided by a rectangular vent duct offset toward the rear of the top cover of the range hood and connected to an upwardly extending rectangular duct. A second alternative is to provide a rearwardly directed exhaust path through the back of the range hood by providing an opening in the back wall of the enclosure to which a vent duct can be affixed. Finally, a forwardly directed exhaust path may be provided through the front wall of the range hood.

As each of the different exhaust paths enumerated above are often encountered, it has heretofore been necessary for manufacturers of ventilating range hoods to provide a separate model adapted for use in a particular exhaust path mode. The result of having a number of different range hood models is that inventory control for manufacturers, dealers and builders is made more difficult.

Therefore, a ventilating range hood that provides a number of selectable exhaust paths is a single model would be most desirable.

SUMMARY OF THE INVENTION

In accordance with the present invention, there is provided a ventilating range hood comprising an enclosure having an air intake opening on the underside and a cover on the top. An internal baffle having an opening therethrough is secured within the enclosure to define an air flow chamber above the intake opening. Means mounted within the air flow chamber and aligned with the opening in the internal baffle is provided for drawing air through the intake opening into the chamber and out through the baffle opening. A first removable plate is provided in the top cover of the enclosure. Upon removal, the top cover plate provides an opening in the top side of the enclosure for receiving therein an air flow duct of either a rectangular or circular configuration to define an upwardly directed exhaust path for air drawn into the enclosure. A second removable plate in the back of the enclosure provides, upon removal, an opening for receiving therein an air flow duct to define a rearwardly directed exhaust path. A removable closure plate in the front of the enclosure, upon removal, provides an opening that constitutes a forwardly directed exhaust path.

In its more particular aspects, the ventilating range hood of the present invention has a sheet metal enclosure comprising a frame having a pair of generally parallel side walls interconnected by front and back walls to form a generally rectangular, box-like enclosure. The removable plate in the top cover has a configuration comprising a rectangular portion and a contiguous curved portion to one side of the rectangular portion. So configured, the top cover plate provides, upon removal, an opening in the top cover adapted to receive therein an air flow duct of either a circular or a rectangular cross-sectional shape.

The opening formed in the top cover by the removal of the top cover plate in one configuration of a top vent exhaust path permits the insertion within the opening of a cylindrical duct. An upturned collar is provided about the periphery of the baffle opening, which collar is adapted to be inserted within the open end of a cylindrical duct received through the opening in the top cover.

In another arrangement, wherein a top vent exhaust path is to be defined by a rectangular duct laterally offset from the center of the baffle opening, the top cover removable plate, is reattached to the top cover after its removal. The plate is adapted to be reattached to a section of the top cover adjacent the opening created by its removal to overlay a portion of the opening and define a substantially rectangular opening in the top cover to accommodate the rectangular duct. Accordingly, the top cover removable plate includes attachment means.

In yet another arrangement, wherein a rear vent is to be provided in the range hood, the back wall removable plate, upon removal, provides a rectangularly shaped opening for receiving therein a rectangular duct.

To provide for a forwardly directed exhaust path arrangement, the closure plate in front of the enclosure includes fastening means for securing the plate to the front wall, whereby the closure plate can be removed to permit access to openings in the front wall. After removal of the closure plate, louvers can be provided in the openings.

DETAILED DESCRIPTION OF THE DRAWINGS

The instant invention will be more particularly understood by reference to the specific embodiments illustrated in the accompanying drawings, wherein.

DESCRIPTION OF THE PREFERRED EMBODIMENT

Figure 1:
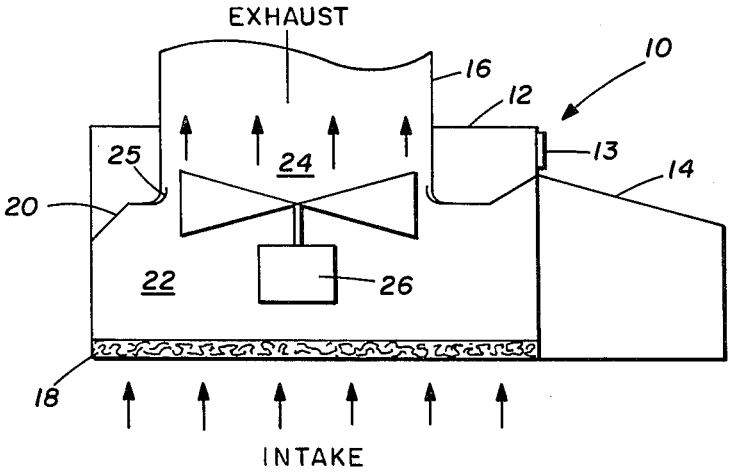
FIG. 1 is a sectional side view of a specific embodiment of a ventilating range hood in accordance with this invention in which an upwardly directed exhaust path formed by a cylindrical top vent duct is being utilized.

FIGS. 1-4 illustrate the selectable exhaust path arrangements provided for by a range hood in accordance with the present invention. More specifically, with reference to FIG. 1, a ventilating range hood 10 comprising a sheet metal enclosure 12 and a hood portion 14 is provided with an upwardly directed exhaust path in the form of a cylindrical top vent duct 16. Air intake into enclosure 12 is through air filter 18 on the underside of enclosure 12. An internal baffle 20 is mounted within closure 12 to define an air flow chamber 22. Internal baffle 20 has an opening 24 therein to provide an outlet for air brought into chamber 22. A motorized fan or blower assembly 26 is mounted within chamber 22 and aligned with the opening 24 in internal baffle 20 for drawing air into chamber 22 and expelling the air through baffle opening 24.

In the exhaust path arrangement shown in FIG. 1, cylindrical duct 16 is inserted through an opening in the top of enclosure 12. The lower end of duct 16 is mated with collar 25 of baffle 20, providing a substantially airtight closure therewith.

Figure 2:
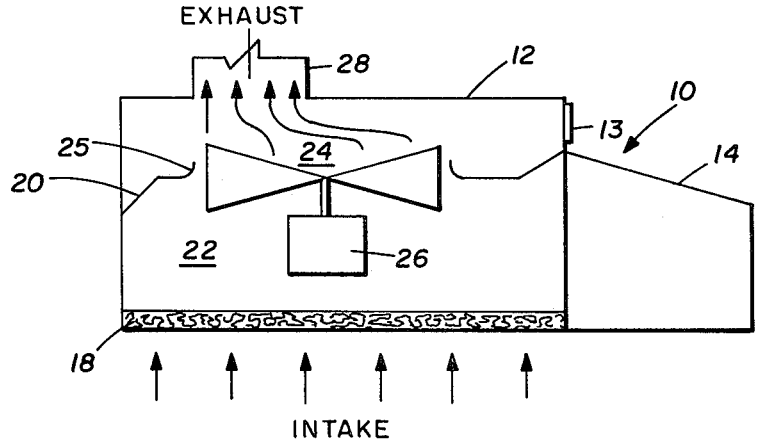
FIG. 2 is a sectional side view of an alternative exhaust path arrangement in the specific embodiment shown in FIG. 1, in which a rectangular top vent duct is utilized.

In the exhaust path arrangement for range hood 10 shown in FIG. 2, the top vent exhaust duct 28 is rectangular, rather than cylindrical. As will be apparent, in the exhaust path arrangement shown in FIG. 2, the available air flow area through the top exhaust vent 28 is reduced from that available with the cylindrical exhaust duct in the arrangement of FIG. 1. However, it will also be appreciated that in the arrangement shown in FIG. 2, a laterally offset top vent is provided, which in many installations is desirable or necessary in order to avoid conflict with structures above the range hood.

Figure 3:
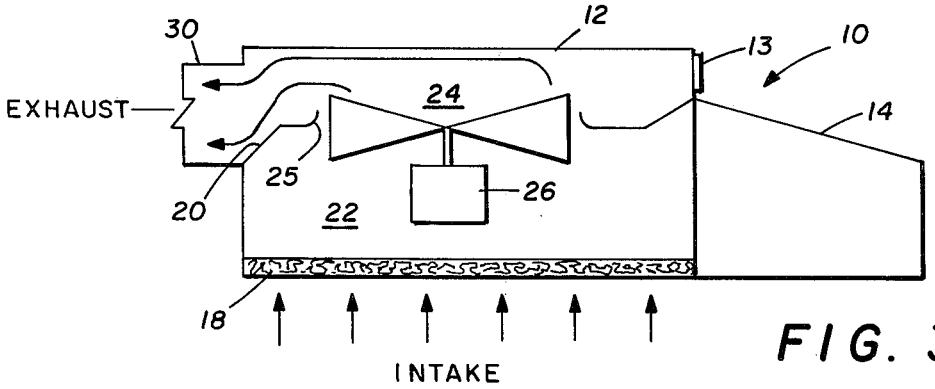
FIG. 3 is a sectional side view of yet another alternative arrangement provided for by the present invention, in which a rearwardly directed exhaust path is provided by a rectangular rear vent duct.

In the exhaust path arrangement shown in FIG. 3, a rearwardly directed exhaust path is provided through a rectangular rear vent 30 that extends laterally of the back of enclosure 12. More specifically, rear vent duct 30 is received into an opening in the back of enclosure 12, which opening places duct 30 in communication with the upper portion of enclosure 12 above baffle 20. In the arrangement of FIG. 3, air drawn by fan assembly 26 through the intake is directed through the baffle opening 24 into the upper portion of enclosure 12. However, unlike the top vent arrangements of FIGS. 1 and 2, the air is directed laterally of the baffle opening to vent duct 30.

Figure 4:
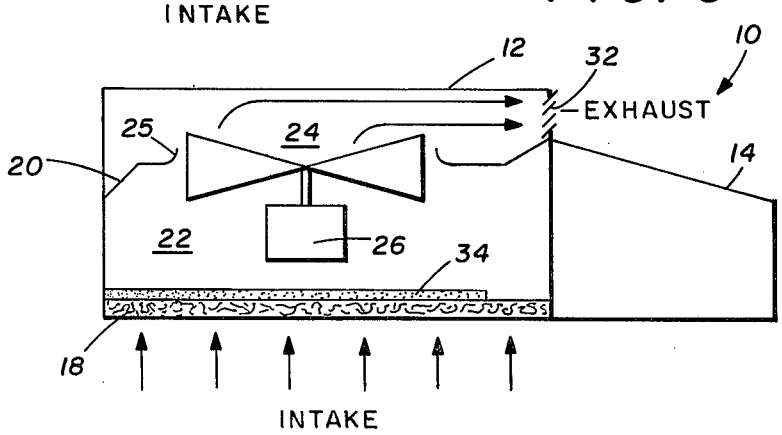
FIG. 4 is a sectional side view of an exhaust path arrangement for the specific embodiment illustrated in FIGS. 1-3, in which a forwardly directed exhaust path is provided through the front wall of the range hood enclosure.

With reference to FIG. 4, yet another exhaust path arrangement provided for by the range hood of the present invention is shown. This arrangement is a forwardly directed exhaust path. In this arrangement, air drawn through the intake into air flow chamber 22 is moved by fan assembly 26 into the upper portion of enclosure 12 and exhausted through openings in the front of enclosure 12. More particularly, removable closure plate 13 is removed to uncover openings in the front portion of enclosure 12. Louvers 32 are inserted within the openings in the front of enclosure 12 and deflect upwardly the air being exhausted therethrough. Also in the exhaust path arrangement of FIG. 4, it is recommended that a charcoal filter 34 be installed in the intake above the aluminum filter 18.

With the four possible exhaust path arrangements provided for by the present invention defined, the description will now be directed to the structural arrangement of one specific embodiment of the present invention, in order that the manner in which the multiple exhaust path arrangements are provided may be better understood.

Figure 5:
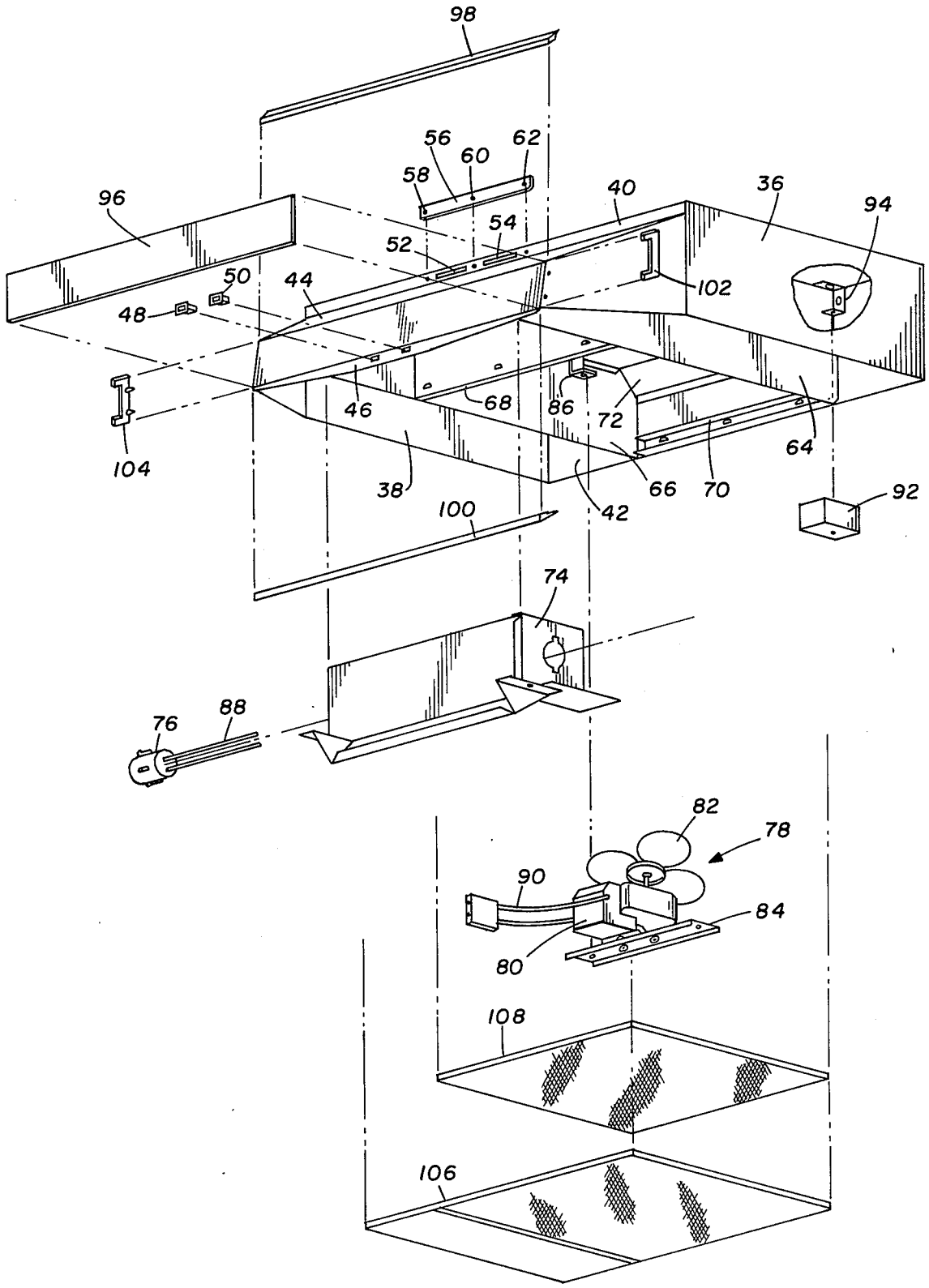
FIG. 5 is an exploded view of the structural elements comprising the specific embodiment of the present invention illustrated in FIGS. 1-4.

Turning now to FIG. 5, an enclosure frame is utilized comprising a pair of generally parallel side walls 36, 38 interconnected by front and back walls 40, 42, respectively. Attached to front wall 40 is a forwardly extending hood portion 44 having a depending switch plate 46 having fan switch 48 and light switch 50 mounted therein.

First and second rectangular openings 52 and 54 are formed in front wall 40. Removable closure plate 56 having fastening means 58, 60 and 62, such as snaps, is placed over openings 52 and 54.

Additional reinforcing structural members are provided for the enclosure frame. These members include longitudinal structural members 64, 66 which extend from back wall 42 forward to the interior of hood 44. Extending transverse to and interconnected with longitudinal members 64 and 66 are transverse members 68 and 70. These additional structural members provide structural stiffness to the ventilating range hood and along with internal baffle 72 define the air flow chamber.

Mounted within the space defined under hood 44 and ahead of transverse structural member 68 is electrical enclosure assembly 74. Carried in assembly 74 is a lamp socket 76. Mounted within the air flow chamber defined by structural members 64-70 and baffle 72 is a means for drawing into the air flow chamber. The means shown is motorized fan assembly 78 comprising an electric motor 80 and a fan blade 82. Fan assembly 78 is mounted on a section of channel iron 84. Mounting of motorized fan assembly 78 is accomplished by the bolting of member 84 to opposing brackets 86. The mounting brackets 86 are themselves mounted to longitudinally extending structural members 64 and 66 on the inside surfaces thereof. Means for drawing air into the air flow chamber can alternatively comprise a blower assembly.

The electrical connections 88 from lamp socket 76 and the electrical connections 90 from motor 80 are connected to an electrical junction box and wire cover 92 mounted outside the fan chamber by a bracket 94.

A front panel 96 is provided on the front of hood 44 along with frame strips 98 and 100. Frame caps 102 and 104 are provided for insertion into snap-in openings on the sides of hood 44 to hold the front panel end of the frame strips in position.

The underside of the enclosure frame is covered by an aluminum filter 106 adapted to be received into the underside of the enclosure between the enclosure frame walls. Further, in the event that the forwardly directed exhaust path through the openings 52 and 54 in front wall 40 are utilized, a charcoal filter 108 is placed above aluminum filter 106.

Figure 6:
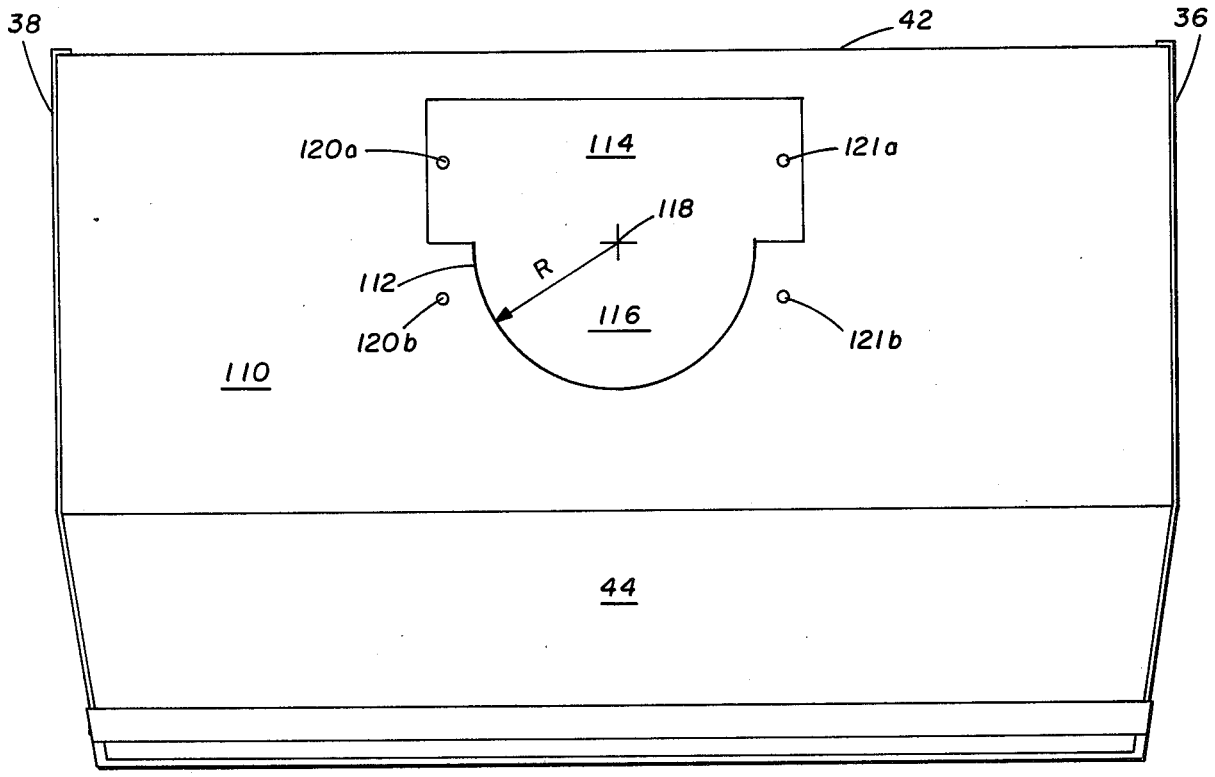
FIGS. 6-8 are top, back and frontal views, respectively, of the range hood shown in FIG. 5.
Figure 7:
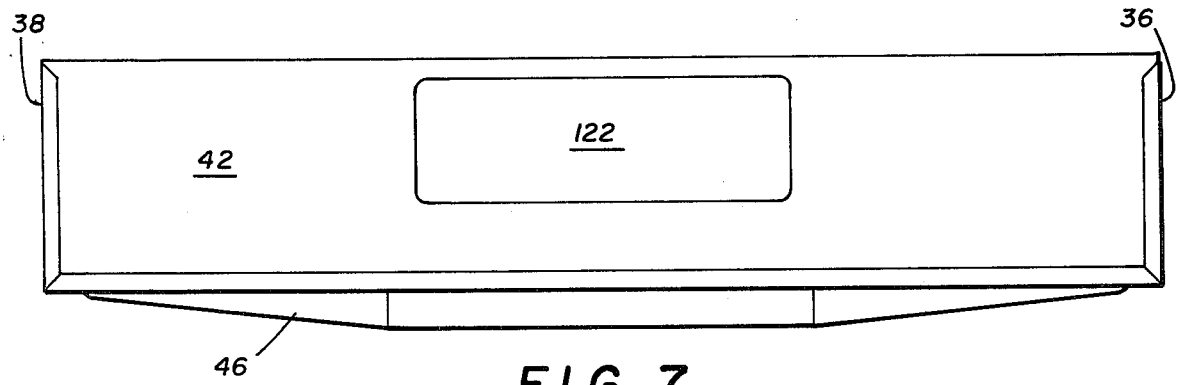
Figure 8:
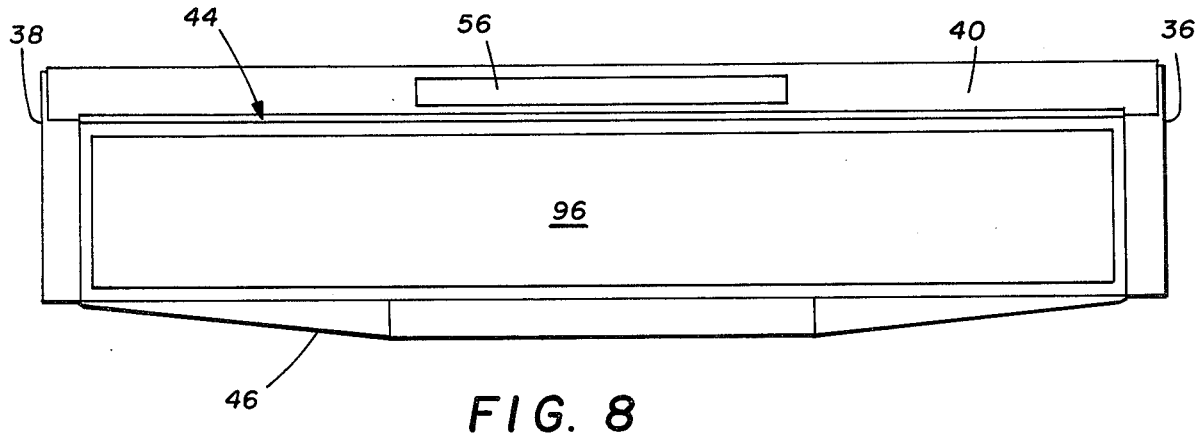

Turning now to FIGS. 6–8, the structural arrangements for the top cover, the front wall and the back wall of the enclosure of the range hood 10 will be described.

With reference first to FIG. 6, top cover 110 is shown having a removable plate 112 formed therein. Removable plate 112 is configured to comprise a rectangular portion 114 and a curved portion 116. The curved portion 116 shown as in semicircular configuration extends to the side of rectangular portion 114 and is attached along side 118. In this arrangement, there is provided, upon removal of plate 112 from top cover 110, an opening through which an air flow duct of either a circular or a rectangular cross-sectional shape can be received to serve as an upwardly directed exhaust path for air being drawn through the fan chamber.

More specifically, in the case in which a cylindrical duct is desired to be utilized, plate 112 is a knock-out plate to be removed and discarded. A cylindrical duct having a radius of curvature corresponding to that of the portion of the opening previously occupied by semicircular portion 116, or a circular duct of lesser dimension, can be inserted through the opening in top cover 110 for mating engagement with an upturned collar on baffle 72.

It is to be noted that, although curved portion 116 is shown to be semicircular, portion 116 can be configured in accordance with any desired portion of a circle. That is, the curved portion can be substantially less than a semicircle or almost an entire circle.

If it is necessary or desired to provide a laterally offset upwardly directed exhaust path, in accordance with the arrangement of FIG. 2, plate 112 is reattached to top cover 110 by moving plate 112 forward and attaching it with two screws placed into corresponding openings 120*a*, 120*b*, and 121*a*, 121*b*. Attached to top cover 110 in the forward position, plate 112 overlays the semicircular portion of the opening in the top cover, such that only a rectangularly shaped opening is provided in top cover 110.

With reference now to FIG. 7, back wall 42 of the enclosure frame of range hood 10 is shown in detail. In back wall 42 is a second plate 122. Removal of plate 122 from back wall 42 provides a rectangularly shaped opening for receiving therein an air flow duct. It will be appreciated that the duct can be attached in a number of ways. For example, the duct can be press fit into the opening and a sealing compound applied therearound. Alternatively, the duct can be welded into the back of the enclosure, or a damper assembly can be attached with screws to the back wall 42 and the duct attached to the damper assembly. A rearwardly directed exhaust path through the opening provided in back wall 42 by the removal of plate 122 corresponds to the arrangement shown in FIG. 3.

Referring next to FIG. 8, a frontal view of hood 44 and front wall 40 is presented. Of particular interest, however, is the positioning of removal closure plate 56 on front wall 40. As will be noted, removable closure plate 56 is disposed substantially in the middle of front wall 40 and adjacent hood 44. Accordingly, upon removal of closure plate 56, a forwardly directed exhaust path, as shown in FIG. 4, is provided and air flow will be out from wall 40 over hood 44.

In a preferred embodiment the top cover removable plate 112 shown in FIG. 6 will provide an opening for accommodating a seven-inch diameter circular duct. Accordingly, the semicircular portion of plate 112 would have a radius of curvature of approximately three and one-half inches.

In the alternative exhaust path configuration corresponding to FIG. 2, wherein a 3¼ inch × 10 inch rectangular exhaust duct is to be utilized, the rectangular portion 114 of plate 112 would be correspondingly sized.

In a preferred embodiment of a range hood set up in accordance with the arrangement of FIG. 3, a rectangular rear vent duct having dimensions of 3¼ inches × 10 inches would necessitate knock-out plate 122 being configured in similar dimensions.

The foregoing description of the invention has been directed to a particular preferred embodiment for purposes of explanation and illustration. It will be apparent, however, to those skilled in this art that many modifications and changes in the range hood described and illustrated herein may be made without departing from the teachings of the present invention. For example, top cover removable plate 112 and back wall removable plate 122 can be knock-out plates formed in their respective enclosure walls. Alternatively, plates 112 and 122 can be affixed by fasteners or a tear strip seal. Accordingly, it is the intention in the following claims to cover all equivalent modifications and variations as fall within the scope of the invention.

What is claimed is:

1. A ventilating range hood having a number of selectable exhaust paths, which comprises:

an enclosure frame having a pair of generally parallel side walls interconnected by front and back walls to form a generally rectangular, box-like enclosure;

a bottom cover comprising air filter means defining an air intake leading to the interior of the enclosure;

an internal baffle mounted within the enclosure spaced above the bottom cover to define an air flow chamber, the internal baffle entending across the interior area defined by the walls and having an opening aligned substantially symmetrically with the air intake;

means mounted within the air flow chamber and aligned with the opening in the internal baffle for drawing air through the intake opening into the enclosure;

a top cover for the enclosure frame having a first removable plate aligned with the opening in the internal baffle;

the first removable plate having a configuration comprising a rectangular portion and a contiguous semicircular portion along one side of the rectangular portion, and providing upon removal an opening in the top cover to receive therein an air flow duct of either a circular or a rectangular cross-sectional shape that serves as an upwardly directed exhaust path through the internal baffle opening for air drawn into the fan chamber;

a second removable plate in the back wall of the enclosure frame providing upon removal an opening for receiving therein an air flow duct that establishes a rearwardly directed exhaust path for air drawn into the fan chamber and through the internal baffle opening;

a third removable plate on the front wall of the enclosure frame providing upon removal access to an opening in the front wall for receiving a set of louvers to establish a forwardly directed exhaust path for air drawn into the fan chamber and through the internal baffle opening; and the top cover of the enclosure and the first removable plate are provided with cooperating attachment means for securing the first removable plate, after its removal from the top cover, to a section of the top cover adjacent the opening created by its removal to overlay the semicircular portion of the opening and define a substantially rectangular opening in the top cover.

2. The range hood of claim 1 wherein:

an upturned collar is provided about the periphery of the internal baffle opening, the collar being adapted to be inserted within the open end of a cylindrical duct received through an opening in the top cover established by the removal of the first removable plate.

3. The range hood of claim 1 wherein:

the first removable plate is positioned in the top cover such that the center of the semicircular portion is substantially aligned with the center of the internal baffle opening and the rectangular portion is laterally offset from the center of the internal baffle opening.

4. The range hood of claim 1 wherein:

the third removable plate includes fastening means for securing the plate to the front wall.

5. The range hood of claim 1 wherein:

the first removable plate and the second removable plate are knock-out plates formed in their respective enclosure walls.

* * * * *